US010954661B2

(12) United States Patent
Polston

(10) Patent No.: US 10,954,661 B2
(45) Date of Patent: Mar. 23, 2021

(54) APPARATUS FOR CLEANING PIPES HAVING PUMPING AND VACUUMING CAPABILITY

(71) Applicant: U.S. Submergent Technologies, LLC, Sarasota, FL (US)

(72) Inventor: Henry B. Polston, Livingston, TX (US)

(73) Assignee: U.S. Submergent Technologies, LLC, Sarasota, FL (US)

( * ) Notice: Subject to any disclaimer, the term of this patent is extended or adjusted under 35 U.S.C. 154(b) by 265 days.

(21) Appl. No.: 15/926,246

(22) Filed: Mar. 20, 2018

(65) Prior Publication Data

US 2018/0209133 A1 Jul. 26, 2018

Related U.S. Application Data

(63) Continuation of application No. 11/057,260, filed on Feb. 14, 2005, now abandoned.

(51) Int. Cl.

| | |
|---|---|
| ***E03F 9/00*** | (2006.01) |
| ***B08B 9/043*** | (2006.01) |
| ***B08B 9/049*** | (2006.01) |
| ***E03F 7/10*** | (2006.01) |

(52) U.S. Cl.

CPC ..... *E03F 9/00* (2013.01); *B08B 9/043* (2013.01); *B08B 9/0495* (2013.01); *E03F 7/10* (2013.01)

(58) Field of Classification Search

None

See application file for complete search history.

(56) References Cited

U.S. PATENT DOCUMENTS

| | | | |
|---|---|---|---|
| 1,437,008 | A | 11/1922 | Otterson |
| 1,561,744 | A | 11/1925 | Raymond |
| 2,010,540 | A | 8/1935 | Evans |
| 2,522,077 | A | 9/1950 | Wahl et al. |
| 2,735,122 | A | 2/1956 | Pletcher |
| 2,782,929 | A | 2/1957 | Colket |
| 3,463,172 | A | 8/1969 | Naylor |
| 3,658,589 | A | 4/1972 | Shaddock |
| 3,842,461 | A | 10/1974 | Wurster |
| 4,134,174 | A | 1/1979 | Flynn et al. |
| 4,139,464 | A | 2/1979 | Coward |
| 4,234,980 | A | 11/1980 | DiVito et al. |
| 4,322,868 | A | 4/1982 | Wurster |
| 4,367,145 | A | 1/1983 | Simpson et al. |
| 4,381,996 | A | 5/1983 | Kugler et al. |
| 4,543,183 | A | 9/1985 | Petretti |

(Continued)

*Primary Examiner* — Nicole Blan

(74) *Attorney, Agent, or Firm* — McDonald Hopkins LLC

(57) ABSTRACT

An apparatus for cleaning waste collection systems of solid materials. The apparatus is capable of cleaning waste systems in two known ways. First, a pumping method uses normal and injected water flow to suspend the solids in a slurry. A submersible pump moves the slurry from a collection point up to a pressurized container where the water content of the slurry is decanted and reused as injection water while the particulate material settles to the bottom of the pressurized container. Second, a vacuum system may be used to move the slurry from the waste system to the waste container. The vacuum system creates a negative pressure differential, causing material to be pulled through a vacuum tube and into the waste container. When the container becomes substantially full of solid particles, it may be emptied at a dumpsite.

10 Claims, 4 Drawing Sheets

(56) References Cited

U.S. PATENT DOCUMENTS

| | | | | |
|---|---|---|---|---|
| 4,578,198 | A | 3/1986 | Schmidt et al. | |
| 4,816,167 | A | 3/1989 | Vanderslice | |
| 4,839,064 | A | 6/1989 | McBurney et al. | |
| 4,854,058 | A | 8/1989 | Sloan et al. | |
| 4,906,366 | A | 3/1990 | Moore | |
| 5,062,963 | A | 11/1991 | Marcinkowski et al. | |
| 5,068,940 | A | 12/1991 | Harve | |
| 5,129,957 | A | 7/1992 | Harve | |
| 5,173,182 | A | 12/1992 | Debellian | |
| 5,250,273 | A | 10/1993 | Hornsey et al. | |
| 5,312,551 | A | 5/1994 | Perron et al. | |
| 5,336,333 | A | 8/1994 | Harve | |
| 5,341,539 | A | 8/1994 | Harve | |
| 5,380,427 | A | 1/1995 | Foss | |
| 5,401,261 | A | 3/1995 | Gunya et al. | |
| 5,417,851 | A | 5/1995 | Yee | |
| 5,503,753 | A | 4/1996 | Woodall et al. | |
| 5,660,725 | A | 8/1997 | Klass | |
| 5,946,767 | A | 9/1999 | Sinz | |
| 6,013,138 | A | 1/2000 | Sinz | |
| 6,391,198 | B1 | 5/2002 | Porter et al. | |
| 6,502,269 | B1 | 1/2003 | Balchan | |
| 6,764,604 | B1 | 7/2004 | Nezat, III | |
| 6,790,368 | B1 | 9/2004 | Vachon | |
| 2002/0162406 | A1* | 11/2002 | Wentworth ..... | E03F 3/06<br>73/865.8 |
| 2005/0247647 | A1 | 11/2005 | Hills | |
| 2007/0163938 | A1 | 7/2007 | Davis | |

* cited by examiner

APPARATUS FOR CLEANING PIPES HAVING PUMPING AND VACUUMING CAPABILITY

CROSS-REFERENCE TO RELATED APPLICATION

This application is a continuation of U.S. patent application Ser. No. 11/057,260, entitled "Apparatus for cleaning pipes having pumping and vacuuming capability" filed on Feb. 14, 2005, which is hereby incorporated by reference.

TECHNICAL FIELD

The present invention relates generally to cleaning waste collection systems such as but not limited to sewers, sumps, wet wells, collection tanks, digesters, clarifiers, classifiers, etc. and in particular to cleaning and removal of solid and liquid materials therefrom.

BACKGROUND OF THE INVENTION

Waste collection systems such as sewers, sumps, wet wells, digesters, clarifiers, classifiers, collection tanks, etc. must be cleaned periodically in order to maintain proper fluid flow and capacity. Cleaning removes sand and other deleterious materials that have infiltrated into, for example, a sewer as well as solid materials that have settled out from the normally slow moving waste slurry that varies in volume and flow rate depending on the collective amount of effluents emptied into the waste collection system over time. In order to properly clean large capacity waste collection systems such as collection tanks or the vast lengths of sewer lines in a typical city, an efficient and cost effective method of cleaning must be employed that can handle the large volume of material that must be removed from a typical waste collection system.

Typically, commercial waste cleaning operations utilize a water jet router made up of a high pressure water pump feeding pressurized wash water through a hose having a cleaning head on its end. This cleaning head has water nozzles on its back face which creates a jet action resulting from the high pressure water flowing out the nozzles. The high pressure water jet action both washes the downstream waste collection system such as sewer pipe and propels the cleaning head upstream for continuous washing action of the entire length of the waste collection system such as sewer pipe being cleaned. The position of the cleaning head and its rate of forward travel is regulated by control of the hose reel integrally mounted on the washing truck.

Commercial waste cleaning operations then utilize one or the other of the following two known systems and methods for moving the resulting water slurry produced from the washing action into a collection box, where the solid material is removed and disposed of in a dump or landfill.

First, a second hose may be lowered into a manhole downstream of the cleaning head and is in communication with the resulting water slurry produced from the washing action. This hose is connected to a vacuum system which lifts the water slurry and all contained debris up from the bottom of the manhole into a vacuum holding tank mounted on the rear of the wash truck. Thus, the high pressure wash water brings the solid materials suspended in water to the manhole and the vacuum action picks up the waste material and deposits it into the truck-mounted holding container.

When the container becomes full, the materials contained in the container are removed and disposed of, typically in a dump or landfill.

Second, the operation may include a semi-submersible pump to move the water slurry produced by the washing action into the collection box. The submersible pump pushes the slurry up in a column through a slurry hose which is connected to and deposit the slurry into a pressurized collection container located on the surface. Again, when the container becomes full, the materials contained in the container are removed and disposed of, typically in a dump or landfill.

Choosing between the use of a submersible pump to push the waste water slurry into the collection container or use of a vacuum to suck the slurry into the container turns largely on the conditions within the waste water system. If, for example, there is a large volume of liquid relative to solids in the slurry, vacuuming becomes very inefficient and possibly infeasible. A vacuum typically pulls out liquid much more easily than the solid material in the slurry. Thus, when a large volume of liquid is in the slurry, the vacuum may pull out only the liquid, leaving the solid material in the waste water system. A submersible pump, by contrast, requires a large volume of liquid to effectively push the slurry upward into the collection box. If very little liquid is present in the waste water system, a pump will be inefficient or may not work at all, and a vacuum is required.

Existing technologies typically include a truck or other apparatus with a high pressure washer, and either a pump or vacuum for moving the waste water slurry into the collection box. Because field conditions dictate which type of technology is used, though, it is generally necessary to go to the particular waste water system to be cleaned and examine the conditions before choosing an apparatus to perform the work and delivering the apparatus to the jobsite.

BRIEF SUMMARY OF THE INVENTION

In contrast to the prior waste cleaning apparatus and methods, the apparatus of the present invention is designed to eliminate the need to examine field conditions prior to dispatching a cleaning apparatus to the jobsite. The apparatus of the present invention has improved the overall cost and efficiency of cleaning waste water systems by using a new, novel and non-obvious combination of apparatus and techniques known in the art.

The apparatus of the present invention is directed to continuous cleaning of waste collection systems such as city sewers, sumps, wet wells, digesters, clarifiers and collection tanks by high pressure water washing of the waste collection system and collection of the resulting solid materials washed therefrom. The present invention may clean any system or device that collects solids, liquids or both. The invention may comprise (1) a source of high pressure water; (2) a submersible pump capable of pumping solids and liquids; (3) a vacuum system capable of vacuuming solids and liquids; (4) a pressurized container where solid materials separate from the liquids (water) by gravity; (5) means to remove the water in the pressurized container separated from the solid materials (decanted water); and (6) means to reuse the decanted water for cleaning of the waste collection system.

The high pressure water source may be a truck-mounted pump connected to a water tank or fire hydrant for its source of water. This pumping truck additionally may comprise a high pressure water hose attached to the pump and a hydraulically actuated hose reel. Mounted at the other end of the high pressure hose may be a bullet-shaped cleaning head. The cleaning head has water jet orifices on its rear face. When high pressure washing water exits through these orifices, the cleaning head is propelled forward by jet action. Rate and distance of cleaning head movement is operator controlled by the hose reel and the tethering restraint of the hose attached to the head. For example, the cleaning head and its attached hose is lowered into a manhole and then placed into the sewer pipe to be cleaned. Next, high pressure water is forced through the rear jets of the cleaning head propelling it into the sewer pipe.

A source of high pressure water may also be derived from a kite. A kite is a funnel made up of flexible material such as, for example, canvass which is restrained by lines to a cable that goes back to the upstream manhole of the waste collection system, such as a sewer. When the kite is placed into a pipe of the waste collection system, water backs up behind it and reduces the flow of water through the pipe to the flow of water that can pass through the diameter of an opening in the end of the kite funnel.

As head pressure builds up behind the kite, water squirts out of the funnel opening like from a high pressure fire hose. For example, at 30 feet of head pressure and a 30-inch diameter pipe reduced to a six-inch opening, there may be 400 psi water coming out of that six-inch hole at the end of the kite funnel. This water pressure is much more than can be generated by a hose/nozzle head as described above. The kite may be reeled downstream through the pipe by paying out the cable attached thereto. As the kite moves downstream through the waste collection system, the solid debris is washed toward the submersible pump or vacuum system.

Yet another source of high pressure water is the Wayne ball. A Wayne ball is a ball that is approximately the same size as the inside diameter of the pipe being cleaned. This ball has concentric helical grooves cut into its surface in which water runs through the grooves and spins the ball. As the Wayne ball spins it agitates the surrounding material in the pipe and moves this material ahead of the Wayne ball toward the submergible pump or vacuum system. The Wayne ball is restrained, like the kite above, on a cable attached pivotally to the ball and allowing the ball to spin from the water flowing through the helical grooves. Water pressures obtained with a Wayne ball are similar to those pressures obtained with a kite.

Pumping Waste Slurry

The washing action of the high pressure water flowing through the above water pressure sources produces a slurry of waste material solids suspended in the wash water and any other liquids present in the waste collection system. If a substantial amount of liquid exists in the waste water system, a submersible pump is used to push the waste slurry created by the high pressure washing action into a pressurized collection box on the surface. The submersible pump has a greater pumping capacity in gallons per minute ("GPM") than does the water flow even with the additional wash water. Thus, little or no flow gets past this submersible pump. The submersible pump is capable of lifting almost pure solids to the surface above the waste collection system. On the surface, a pressurized waste container is used for the collection of the slurry.

The pressurized container receiving the slurry from the submersible pump works with a positive pressure to atmosphere. This allows rapid settlement to the bottom of the container of the solid materials in the slurry by means of gravity. Thus, the water contained in the slurry will float to the top of the settled solids and may be easily removed and reused and only the solids need to be transported away and disposed of at a dump.

In practice, the slurry hose is in communication with the top of the pressurized container and the solid material rapidly falls out of the incoming slurry in a cascade gradient where the highest part of the solid material pile is closest to the slurry inlet. Means for removal of water separated from the slurry ("decanted water") allows the apparatus of this invention to continuously reuse a substantial amount of the wash water for further cleaning operations. Thus, a significant advantage of the submersible pump is the conservation of water by almost total capture and subsequent reuse of both wash water and normal sewer water flow.

Filtered decanted water may be used as a water source for the high pressure water pump. In addition, excess decanted water may be emptied upstream of the washing operations, thus, improving existing cleaning operations water flow. In practice, faster and better waste collection system washing operations are achieved when the water flow and volume are increased. Thus, as mentioned above, the submersible pump does not require a limited water flow as does the vacuum system, and actually benefits from increased water flow.

A submersible pump is also capable of handling a much higher flow capacity than a vacuum system. For example, a vacuum system can handle only about 700 GPM of waste slurry. A pump, by contrast, can typically handle about 2,500 GPM of slurry. Thus, a submersible pump may be preferred in some situations because it can pump slurry into the collection container at a much higher rate than the vacuum can handle.

Using a submersible pump with a positive pressure collection container allows for decanting slurry water back into the manhole as the solid material settles out in the collection box simultaneously with the pumping of waste slurry into the collection box. This simultaneous decanting is unavailable using a vacuum system. Thus, when using a submersible pump, the process needs to be stopped to unload the material from the collection box only when the box is completely filled with solid material. By contrast, vacuuming must cease when the collection box fills up with a combination of solid material and liquid. The more frequent stoppage using a vacuum system results in less efficient operation. Subsequently, use of a submersible pump allows for cleaning more length of pipe per time interval than does vacuuming.

Vacuuming Waste Slurry

A submersible pump requires a significant amount of liquid in the system to be cleaned in order to operate effectively. When there is not enough liquid to utilize the pumping system, the present invention is capable of using a vacuum system to handle drier materials in much the same way as conventional vacuum cleaning systems. As discussed above, the vacuum system is somewhat less efficient than the pumping system. However, in dry conditions it is necessary to use a vacuum rather than a pump to move waste slurry to the surface and into the collection container. Unlike any previously utilized technology, the present invention may be easily converted between pumping and vacuuming as conditions dictate.

An object of the present invention is to efficiently wash sewer and other pipe lines by using either a submersible pump or vacuum technology to move waste slurry scrubbed from the pipe by high pressure water to the surface and into a collection container.

A further object of the present invention is to switch quickly and easily between a submersible pump and vacuum technology to move waste slurry scrubbed from a pipe by high pressure water to the surface and into a collection container.

Yet a further object of the present invention is to provide an apparatus capable of utilizing either a submersible pump or vacuum technology to move waste slurry scrubbed from a pipe by high pressure water to the surface and into a collection container, such that pipe conditions and liquid content do not need to be identified prior to dispatching the apparatus to the jobsite.

DETAILED DESCRIPTION OF EXEMPLARY EMBODIMENTS

Figure 1:
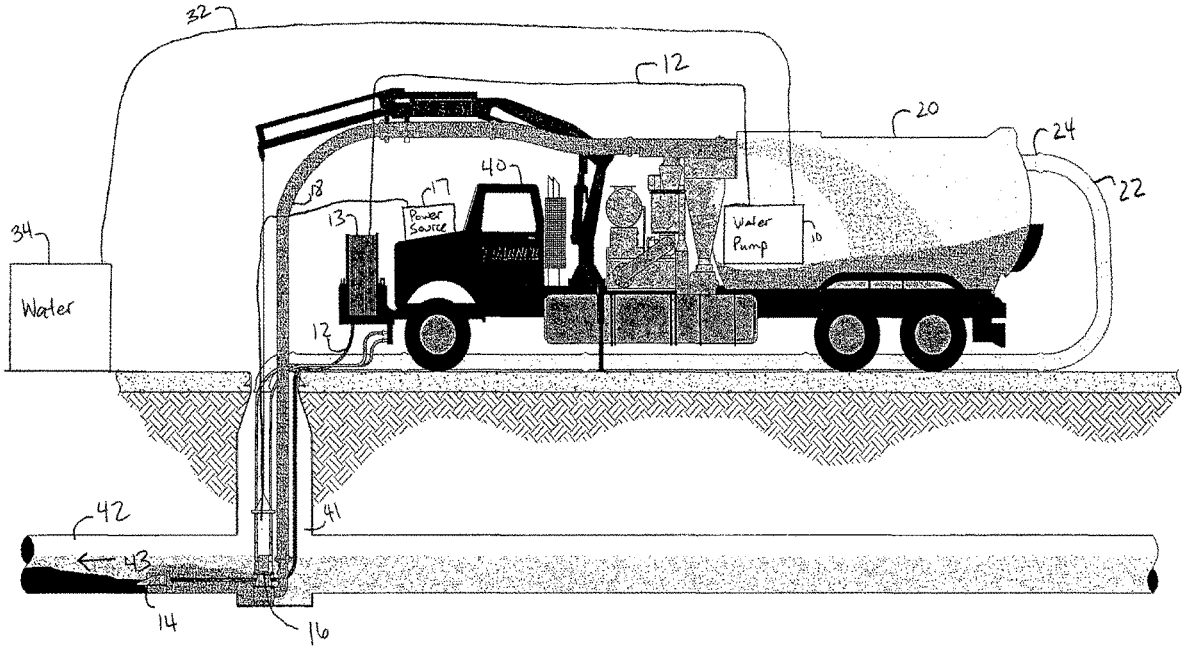
FIG. 1 is a view of an embodiment of the apparatus of the present invention wherein a submersible pump is utilized to pump the waste slurry into the waste container.
Figure 2:
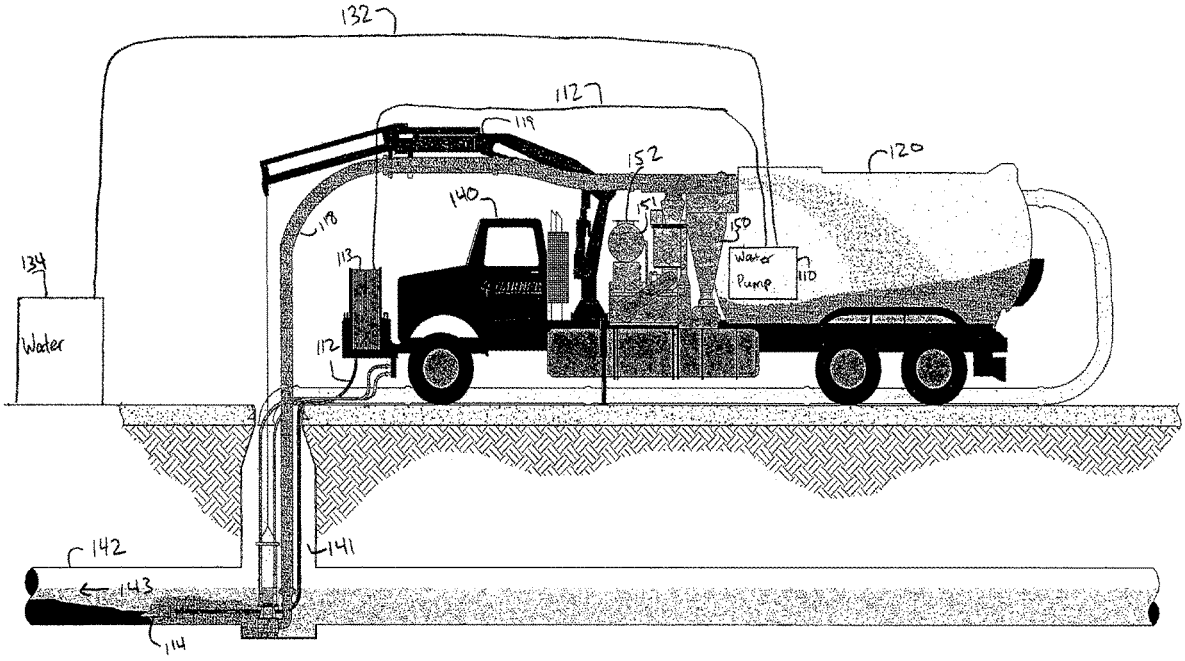
FIG. 2 is a view of an embodiment of the apparatus of the present invention wherein a vacuuming system is utilized to move the waste slurry into the waste container.
Figure 3:
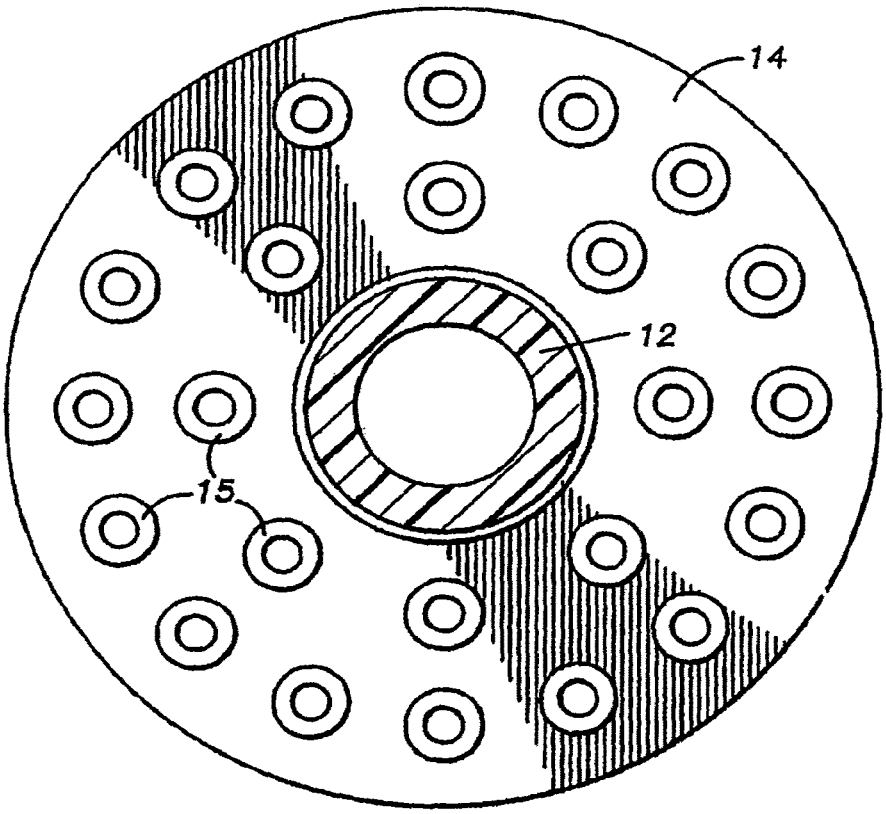
FIG. 3 is a rear view of a cleaning head.

Referring now to FIGS. 1 and 2, the system of the present invention comprises a high pressure water pump assembly 10 for generating high pressure water, a high pressure water hose 12, a hose reel 13, a bullet-shaped cleaning head 14 for receiving high pressure water and cleaning a sewer, a submersible pump 16 for pumping a slurry of solids and liquids out of the sewer when the slurry contains a large amount of liquid, a power source 17 for the submersible pump 16, a slurry hose 18, a waste container 20 for receiving the pumped slurry, a decant water hose 22, a decant water outlet 24 for releasing the water from the container, main supply water line 32, and main supply water source 34. The invention may be mounted to a truck 40 as seen in FIGS. 1 and 2, or to an immobile unit that must be towed to and from a jobsite. For consistency, the unit will be described as a truck throughout this document.

The high pressure water pump assembly 10 and pump power source 17 are mounted on, for example, a truck 40 and may use the truck engine for power. The purpose of the pump assembly 10 is to pressurize water for use in washing sewer lines 42 by means of cleaning head 14 attached to and in communication with high pressure water hose 12. The source of water for pump assembly 10 may be derived from any water source 34, including a fire hydrant, a tank on the truck 40, or from the sewer 42 itself.

The cleaning head 14 is bullet-shaped with a front and rear face. The rear face of the cleaning head 14 has water jet outlets 15 directed backwardly. The truck 40, high pressure water hose 12 and cleaning head 14 may be of any suitable conventional equipment. When the cleaning head 14 is lowered through a manhole 41, and into a sewer 42, high pressure water, such as 2000 psi is applied through the hose 12 to the cleaning head 14. The high pressure water applied to the cleaning head 14 has several functions. First, the water sprays out of the outlets 15 and the exiting high pressure water washes the solid material from the walls of the sewer 42 and suspends the sewer pipe solid material in a slurry. Additionally, the high pressure water being applied to the cleaning head 14 moves the cleaning head 14 in a direction 43. After cleaning the sewer 42, the cleaning head 14 may be retrieved by retracting the high pressure water hose 12 by means of hose reel 13 as is conventional.

If conditions dictate that a submersible pump 16 should be used, i.e., if a relatively high volume of liquid exists in the sewer 42, a submersible pump 16 is provided with a capacity of more than the total flow of water being injected to the cleaning head 14 as well as any normal sewer flow. It is desirable to have a large water content in the sewer 42 for efficiently cleaning the sewer 42 by suspending the solid particles and material in the sewer 42 in a liquid slurry. The submersible pump 16 is capable of pumping a slurry having up to 80% solids.

For example only, if the high pressure water pump provides a flow of 60 gallons per minute, a suitable submersible pump 16 capable of removing 2000 gallons a minute of 80% solid material is desirable for allowing the present invention to clean an operating sewer having flowing fluids therein. While any suitable submersible pump 16 may be provided, pump series 53, sold by Garner Environmental Services, Inc., is satisfactory. Such pumps can be powered hydraulically and powered by diesel, electric motors, gasoline engines or any other available power source.

The fluidized slurry from the submersible pump 16 is transmitted through the slurry hose 18 to a waste container 20. The fluidized slurry enters the top of the container 20, where the solids and water separate and the solids settle to the bottom of the container by gravity. If desired, baffles may be provided in the container 20 to assist in the separation. The water is then decanted from the container 20 and as the container 20 fills up, the decanted water is released from the container 20 by means of the positive pressure forcing the water through a decant water hose 22.

The waste container 20 may be either permanently affixed to the truck 40, or may be removable therefrom. If the waste container 20 is removable, when the container 20 is substantially filled up with solid particles, it may be removed and a replacement container 20 may be rolled into place and connected to hoses 18 and 22. The filled container 20 may then be removed to a dump site while the truck 40 remains on site and continues the cleaning operation. If the waste container 20 is permanently affixed to the truck 40, the truck 40 must go to the dump site each time the waste container 20 becomes substantially filled up with solid materials.

When the submersible pump 16 is used, the more water that flows through the cleaning head 14 and sewer 42 the better the cleaning operation. In the present system, the decanted water can be used to provide additional washing by injecting it upstream of the cleaning head 14 and pump 16. This allows keeping the solid materials in the sewer in suspension so that they can more easily be removed by the pump 16. The decanted water is transmitted through decant water outlet 24 to decant waterline 22 and then to a manhole 41 into the sewer 42 upstream of the cleaning head 14 for increasing the water in the sewer flow.

This additional water, applied to the sewer 42 aids in more efficiently cleaning the sewer 42, and the pump 16 has the capacity to completely remove the water in the system. Thus, the present embodiment is in effect a closed loop and the decanted water, all water injected or decanted, is utilized in cleaning the upstream portion of the sewer. Furthermore, the water need not be disposed of by trucking. After the sewer 42 is cleaned, the cleaned decanted water may be disposed of in the sewer 42. For example, present systems utilize 60 gallons of water per minute for injection from the cleaning head 14. If additional water is available for supply to the cleaning head 14, a better water injection system and cleaning system can be provided. When cleaning a fully charged sewer, i.e., sewer capacity at maximum, the decanted water may be disposed of in a downstream sewer.

Referring now to FIG. 2, the system comprises a truck-mounted high pressure water pump assembly 110 for generating high pressure water, a high pressure water hose 112, a hose reel 113, a bullet-shaped cleaning head 114 for receiving high pressure water and cleaning a sewer, a vacuum system comprising a vacuum tube 118 held in place by a boom 119, an air pump 150 used to create the vacuum, generally located at or near a silencer 151 and a discharge point 152 where air is released to the atmosphere. The system further comprises a waste container 120 for receiving the pumped slurry, a main supply water line 132, and a main supply water source 134.

The high pressure water pump assembly 110 is mounted on, for example, a truck 140. The purpose of the pump assembly 110 is to pressurize water for use in washing sewer lines 142 by means of cleaning head 114 attached to and in communication with high pressure water hose 112. The source of water for the pump assembly 110 may be derived from any water source 134, including a fire hydrant, a tank on the truck 140, or from the sewer itself.

The cleaning head 114 is bullet-shaped with a front and rear face. The rear face of the cleaning head 114 has water jet outlets directed backwardly. The truck 140, high pressure water hose 112 and cleaning head 114 may be of any suitable conventional equipment. When the cleaning head 114 is lowered through a manhole 141, and into a sewer 142, high pressure water, such as 2000 psi is applied through the hose 112 to the cleaning head 114. The high pressure water applied to the cleaning head 114 has several functions. First, the water sprays out of the outlets and the exiting high pressure water washes the solid material from the walls of the sewer 142 and suspends the sewer pipe solid material in a slurry. Additionally, the high pressure water being applied to the cleaning head 114 moves the cleaning head 114 in a direction 143. After cleaning the sewer 142, the cleaning head 114 may be retrieved by retracting the high pressure water hose 112 by means of the hose reel 113 as is conventional.

If conditions dictate that a vacuum system be used, i.e., if a relatively small volume of liquid exists in the sewer 142, a vacuum system comprising a vacuum tube 118 held in place by a boom 119, an air pump 150, generally located at or near a silencer 151 and a discharge point 152 where air is released to the atmosphere, is provided. The air pump 150 creates a negative pressure in the system, causing slurry to be sucked up through the vacuum tube 118 and into the waste container 120. The solid material in the waste slurry then falls to the bottom of the waste container 120. The air pump 150 continues to pull the air in the container through the air pump 150, and through the silencer 151 before being released to the atmosphere through the discharge point 152.

The embodiment depicted in FIG. 2 is less efficient than that depicted in FIG. 1, because a submersible pump is capable of moving waste slurry at a faster rate than a vacuum system. Further, use of a submersible pump allows for decanting of water simultaneously while performing the cleaning operation. This is not possible with a vacuum system. However, because a submersible pump cannot be used effectively when little or no water exists in the pipe to be cleaned, the vacuum system is necessary to deal with these types of situations.

Figure 4:
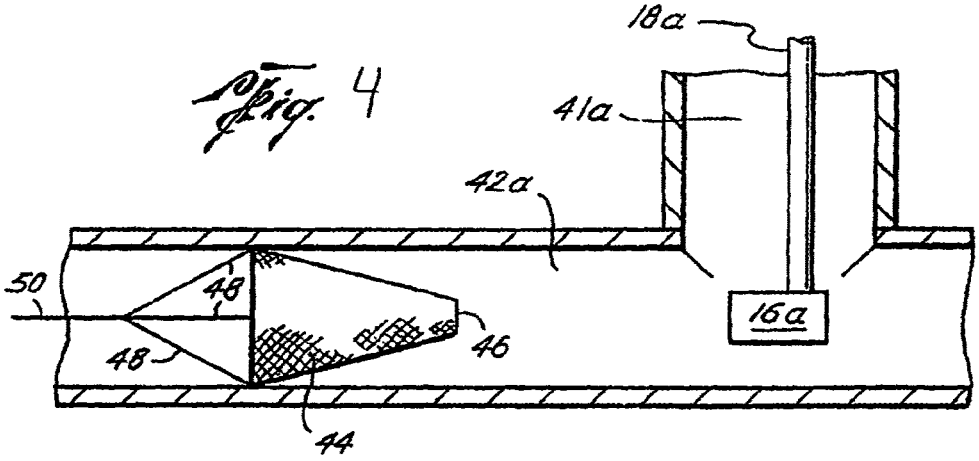
FIG. 4 is a view of a kite as used in the present invention.
Figure 5:
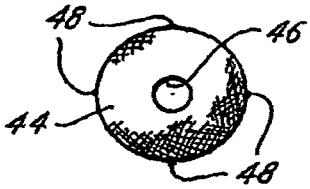
FIG. 5 is a front view of the kite of FIG. 4.

Loosening solid materials, i.e. debris, mud, etc. from the walls of the waste collection system and getting the solid materials to the submersible pump 16 requires a high pressure stream of water. A pressurized water pumping system as described above is not always available or practical for cleaning the waste collection system. Referring now to FIGS. 4 and 5, a kite 44 is illustrated schematically. The kite 44 is placed in sewer 42*a* upstream of submersible pump 16*a*. Water flowing in sewer 42*a* is blocked by the kite 44 acting effectively as a dam. The only exit for the dammed water is through opening 46. Water builds up behind kite 44 forming a hydrostatic head pressure that creates a high pressure stream of water emitting from the opening 46 of the kite 44 apex. This high pressure stream of water effectively breaks loose solid material attached to the walls of sewer 42*a* and allows sufficient flow rate to suspend the solid materials in the water for subsequent removal by submersible pump 16*a*.

The position of kite 44 in the sewer 42*a* is controlled by cable 50 attached to the kite 44 by lines 48. Kite 44 is made of a flexible water proof material such as, for example, canvas. The flexible material is formed into the shape of a funnel and restrained by lines 48 which in turn are attached to the cable 50.

Figure 6:
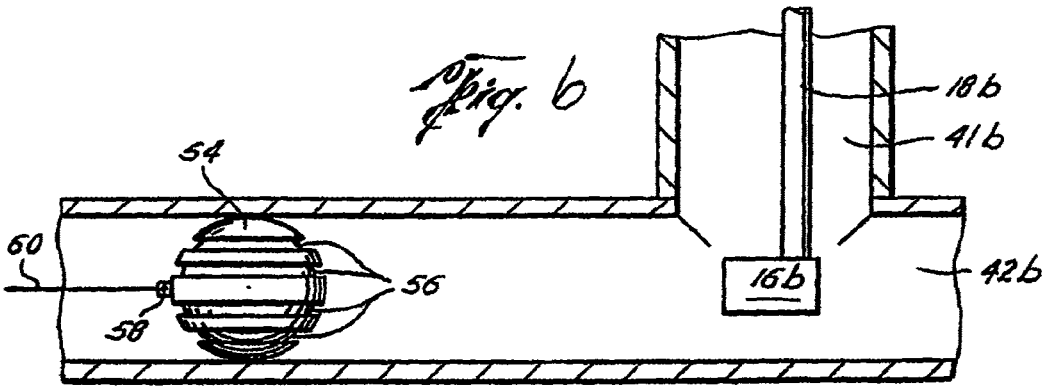
FIG. 6 is an elevational view of a Wayne ball as used in the present invention.

Referring now to FIG. 6 a Wayne ball 54 is illustrated schematically. The Wayne ball 54 is a ball having a diameter approximately the same size as the inside diameter of the pipe to be cleaned. The Wayne ball 54 has concentric helical grooves 56 on its face in which water flows at high pressure while rotating the Wayne ball 54. The position of Wayne ball 54 is controlled by cable 60 which is pivotally attached by means of pivot 58. The rotation of Wayne ball 54 and the high pressure streams of water emitting from grooves 56 agitates the solid materials built up on the walls of sewer 42*b*. In addition, the high pressure water effectively washes and cleans the material from the walls while moving the suspended solids down toward the submersible pump 16*b*.

The present invention is not limited to just cleaning sewers, any waste collection system such as but not limited to sewers, sumps, wet wells, collection tanks, digesters, clarifiers, classifiers, etc. where cleaning and removal of solid and liquid materials is required. The present invention is a new, novel and more efficient way of capturing solid and liquid waste by emulsifying the solids in suspension and capturing it by the means disclosed above. The apparatus of the present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will readily suggest themselves to those skilled in the art and which are encompassed within the spirit of the invention and the scope of the appended claims.

Having thus described the invention, I claim:

1. A method of cleaning a waste collection system containing liquid and solid materials, the method comprising:

inserting a cleaning head into the waste collection system;

dispersing high pressure liquid into the waste collection system through a pump positioned on a mobile platform through the cleaning head;

inserting a submersible pump into the waste collection system;

pumping the liquid and solid materials via positive pressure into a waste container on the mobile platform from the submersible pump; and vacuuming the liquid and solid materials via negative pressure into the waste container on the mobile platform through a vacuum system positioned on the mobile platform, wherein the pumping and vacuuming are not performed simultaneously.

2. The method of claim 1, wherein the waste collection system includes at least one of a sewer, sump, wet well, collection tank, digester, clarifier, and classifier.

3. The method of claim 1, wherein the vacuuming is converted to the pumping.

4. The method of claim 1, wherein the submersible pump pushes the liquid and solid materials into the waste container.

5. The method of claim 1, wherein the vacuum system lifts the liquid and solid materials.

6. The method of claim 1 further comprising releasing air to atmosphere during vacuuming.

7. The method of claim 1, wherein the pumping is converted to the vacuuming.

8. The method of claim 1 further comprising decanting liquid from the waste container while pumping, but not while vacuuming.

9. The method of claim 1, wherein the step of pumping the liquid and solid materials via positive pressure into the waste container on the mobile platform from the submersible pump occurs when there is more liquid material in the liquid and solid materials.

10. The method of claim 1, wherein the step of vacuuming the liquid and solid materials via negative pressure into the waste container on the mobile platform through the vacuum system occurs when there is more solid material in the liquid and solid materials.

* * * * *